US007278621B1

(12) United States Patent
Bareis

(10) Patent No.: US 7,278,621 B1
(45) Date of Patent: Oct. 9, 2007

(54) ADAPTIVE EASEL

(76) Inventor: Kathryn M. Bareis, 4950 S. Lowes Creek Rd., Eau Claire, WI (US) 54701

( * ) Notice: Subject to any disclaimer, the term of this patent is extended or adjusted under 35 U.S.C. 154(b) by 89 days.

(21) Appl. No.: 11/218,758

(22) Filed: Sep. 2, 2005

Related U.S. Application Data

(60) Provisional application No. 60/606,692, filed on Sep. 2, 2004.

(51) Int. Cl.
*A47B 5/04* (2006.01)

(52) U.S. Cl. ..... 248/441.1; 248/558

(58) Field of Classification Search ..... 248/441.1, 248/448, 449, 460, 463, 464, 558, 447, 457
See application file for complete search history.

(56) References Cited

U.S. PATENT DOCUMENTS 4,129,916 A * 12/1978 Schlesinger et al. ..... 14/69.5
4,259,821 A * 4/1981 Bush ..... 52/309.1
4,274,222 A * 6/1981 Zahn et al. ..... 446/126
4,610,414 A * 9/1986 Schuck ..... 248/449
4,714,224 A * 12/1987 Calmes ..... 248/465
5,005,795 A * 4/1991 Holmgren ..... 248/449
2001/0054674 A1* 12/2001 Turner ..... 248/441.1
2005/0022465 A1* 2/2005 Warren et al. ..... 52/653.2

* cited by examiner

*Primary Examiner*—Ramon O Ramirez
(74) *Attorney, Agent, or Firm*—Anthony J. Bourget

(57) ABSTRACT

An adaptive easel accommodating multiple orientations, the easel comprising a plurality of legs, at least two of the legs connected to define a first side upon which the easel sits, and at least two of the legs connected to define a second side upon which the easel alternatively sits, at least one of the legs capable of receiving a work surface whereby the easel may sit in a variety of orientations to present a variety of work surface orientations for holding an artistic medium.

22 Claims, 4 Drawing Sheets

ADAPTIVE EASEL

CROSS-REFERENCE TO RELATED APPLICATIONS, IF ANY

Applicant claims priority based on Provisional Patent Application No. 60/606,692, filed Sep. 2, 2004.

FIELD OF THE INVENTION

This invention relates to easels, and more particularly to multi-positionable structures having a work surface.

DESCRIPTION—BACKGROUND OF PRIOR ART

Easels have a frame for holding an artist's canvas or a picture. Typical easels include a stand so the artist can position the work area as desired. However, typical easels, frames and stands are generally limited in the variety of arrangements available for accommodating use by a diverse group of users.

Generally an artist may stand or sit before a conventional easel. An artist who is confined to a wheelchair, however, is often limited in the use of a conventional easel. While a conventional easel may be placed on a table, many wheelchairs are not configured to fit under a table for proper use. Also, some wheelchairs come equipped with a tray which further makes it difficult for fitting under a regular desk. While a conventional easel may be lowered to a position to accommodate one user, the easel usually requires careful and time-consuming adjustment from person-to-person. Positioning the easel at an appropriate distance from the artist can also be difficult with conventional easels. Moreover, conventional easels do not conveniently attach to a wheelchair or wheelchair tray, and are not easily positionable in a variety of configurations.

The present invention provides for an easel that accommodates a variety of configurations and is easily adapted to work from artist to artist. It especially allows teachers of students in wheelchairs an opportunity to quickly position the easel as needed. It is also easy to remove, store and transport.

DETAILED DESCRIPTION OF THE PREFERRED EMBODIMENTS

The present invention is directed to an adaptive easel accommodating multiple orientations or positions. The easel may be flipped and/or rotated so that the easel may sit on one of many sides. The easel is configured to receive a work surface at a variety of locations.

Figure 1:
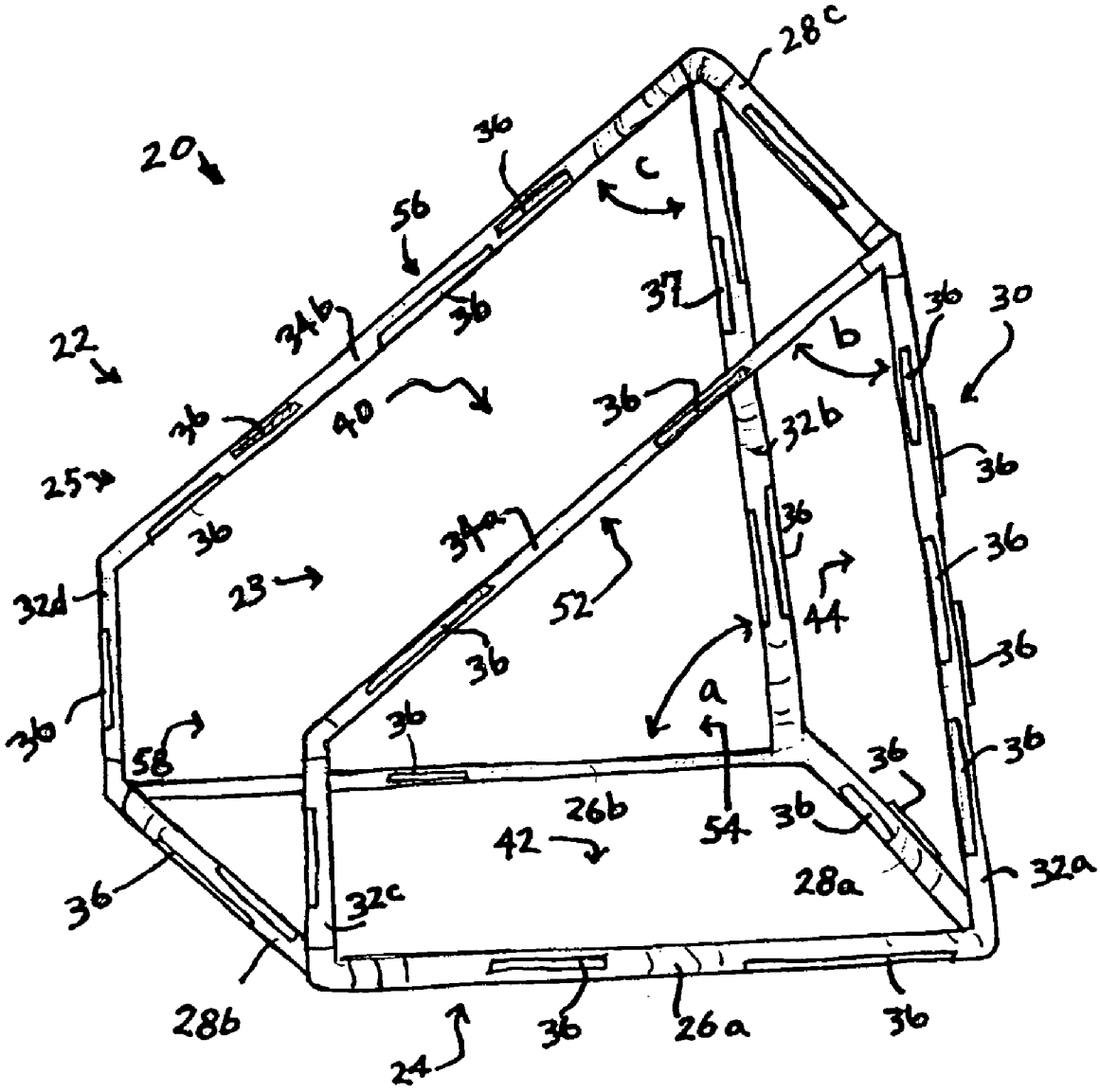
FIG. 1 is a perspective view of the easel of the present invention.

As shown in FIG. 1, easel 20 includes frame 22. Easel 20 is an adaptive easel accommodating multiple orientations for receiving a work surface 38 (See FIG. 2). Frame 22 is generally of an open variety and is preferably configured to generally bound an interior space 23. As shown in FIG. 1, frame 22 is constructed of a plurality of legs 25. More particularly, frame 22 includes a number of opposed legs 26*a,b*, 28*a,b,c*, 32*a,b,c,d* and 34*a,b* (hereinafter referred to collectively as legs 25 and/or opposed legs). For instance, leg 26*a* is opposed or aligns opposite leg 26*b*. Preferably, leg 26*a* is parallel, or substantially parallel, to leg 26*b*. While similar parallel relationships exist between the other opposed legs as shown, it can be appreciated that non-parallel legs 25 still meet within the scope of the invention. It can also be appreciated that not all legs 25 require a corresponding opposing leg. While Legs 25 are preferably a plurality of tubes which form a perimeter of frame 22, it can be appreciated that frame 22, or portions thereof, can be constructed of larger tube segments or molded pieces.

Legs 25 are configured in a generally box-like arrangement and preferably include a frame perimeter having multiple sides. Opposed Legs 26*a,b* define a region preferably lying on a first plane 42 and generally depicted as bottom side 24. Opposed Legs 32*a,b* define a region preferably lying on a second plane 44 and generally depicted as back side 30. Opposed Legs 34*a,b* define a region preferably lying on a plane and generally depicted as top side 40. Legs 26*a*, 32*a*, 32*c*, and 34*a* define a region preferably lying on a plane and generally depicting a right side 54. Legs 26*b*, 32*b*, 32*d*, and 34*b* define a region preferably lying on a plane and generally depicting a left side 56. Legs 32*c* and 32*d* generally define front side 58. It can be appreciated that bottom side 24 (bottom), back side 30 (back), top side 40 (top), right side 54 (right), left side 56 (left), and front side 58 (front) form a generally box-like structure bounding an interior space 23. (Sides 24, 30, 40, 54, 56, 58 hereafter referred to as a side 29 or sides 29). It can be appreciated that legs 25 do not have to be opposed in order to define a side 29, since adjacent non-opposed legs 25 (i.e., leg 26*a* and leg 28*a*) also define bottom side 24. While not preferred, it can be appreciated that frame 22 may selectively include a side or sides that comprise a surface material (not shown).

Easel 20 may be placed on a surface (surface not shown) such that easel 20 sits on bottom side 24 as shown in FIG. 1. Specifically, easel 20 sits on legs 29 which define bottom side, and particularly legs 26*a,b* and 28*a,b* (or some of them) which define bottom side 24. Easel 20 may alternatively sit on back side 30, top side 40, right side 54, left side 56, and in some instances, front side 58. It may be appreciated that the length of legs 29 and spacing between legs 29 may vary to accommodate any number of desired configurations and angles.

Frame 22 is preferably made of angled joints and tubing or legs 25. Preferably, legs 25 or some of them, are made from lightweight PVC tubing, which allows for a lightweight yet durable and rugged support structure or easel 20. While a variety of attachment mechanisms known in the art (including but not limited to stick pins, suction cups, magnets, hooks, straps, snap on devices, and the like) may be used to connect work surface 38 to easel 20, hook-and-loop fasteners 36 are preferably used. Preferably each of legs 25 includes at least one hook-and-loop fastener component. The hook-and-loop fastener component, such as Velcro®, is designed to fasten or mate to another like-kind hook-and-loop fastener component 36 as is commonly understood (one component being hook and the other component being loop).

Figure 2:
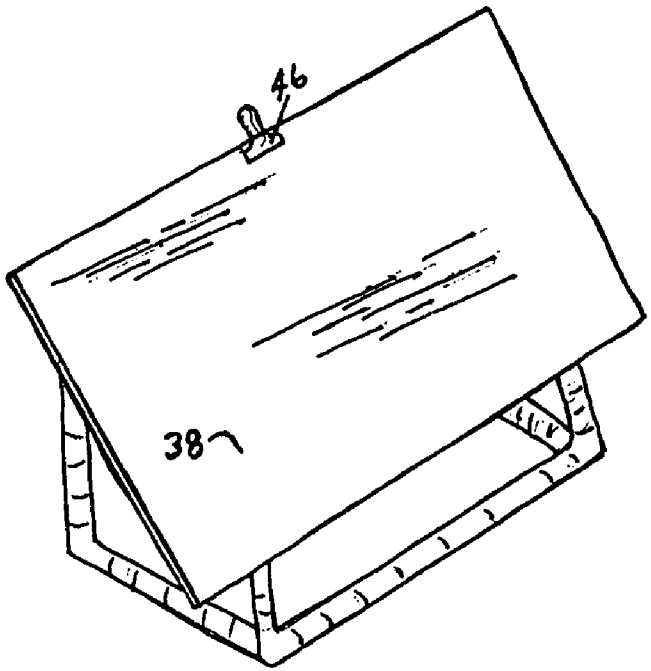
FIG. 2 is a front perspective representation of the easel of the present invention having an attached work surface.
Figure 3:
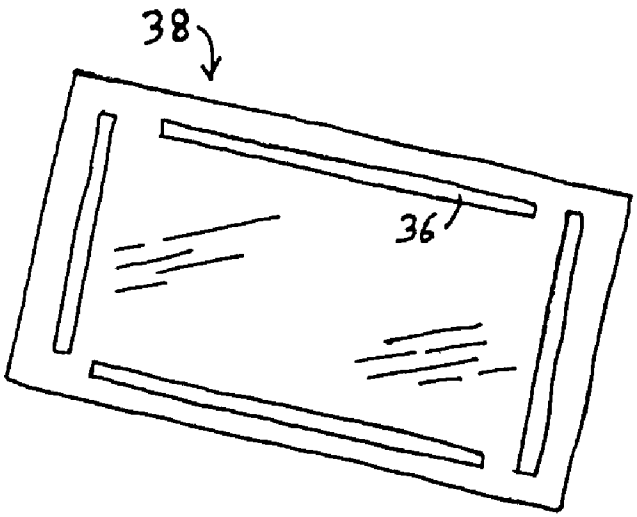
FIG. 3 is a rear view of a work surface used in conjunction with the present invention.

As shown in FIG. 2, a work surface 38 includes a hook-and-loop fastener component 36 so that such component can fasten to at least one of the hook-and-loop fastener component 36 contained on Frame 22. Preferably hook-and-loop fasteners 36 are contained on all the external edges of legs 25 so as to accommodate selective fastening of work surface 38. It can be appreciated that work surface 38 can therefore be fastened to easel 20 at a variety of positions including at any one of sides 24, 30, 40, 54, 56, or 58. Preferably work surface 38 is large enough to accommodate poster-size sheets of paper, and as shown in FIG. 2 is approximately 3 feet by 2 feet. Preferably surface 38 includes a portrait and an alternate landscape dimension to accommodate holding of a variety of art media. Preferably work surface 38 is a white board or has dry-erase characteristics as is known by those skilled in the art. Fasteners 36 are positioned on work surface board 38 to align with corresponding fasteners 36 located on frame 22 in either a portrait or landscape configuration.

Easel 20 is flippable in that it can be rotated and/or turned or moved about in three dimensions so as to accommodate for various orientations, which allow easel 20 to be adapted to fit the particular use or student (i.e., side 24 can be positioned for use as the bottom, back, top, sides, etc). FIG. 1 depicts easel 20 situated such that first side 24 is at a bottom location. It can be appreciated that easel 20 is flippable in that second side 30 can be situated such that second side 30 is at the bottom location. It can be further appreciated that any one of sides 24, 30, 54, and 56 can be oriented to be the bottom or first side of easel 20. In an appropriate application front side 58, or the sixth side as the case may be, might also be considered a bottom.

As shown in FIG. 1, bottom side 24 and right side 54 are aligned generally perpendicularly to each other. Preferably, at least two sides are arranged in a perpendicular fashion. Also, shown in FIG. 1, back side 30 is preferably not positioned in a perpendicular configuration with respect to bottom side 24. While it can be appreciated that the angle represented by arrow A (spanning between leg 26*b* and leg 32*b*) can be ninety degrees, preferably the angle is something less, such as between approximately 65 and 70 degrees. Such angle provides for greater versatility in the use of easel 20 so the user can have a greater variety of orientations and angles to conveniently support a work surface 38 that is connected to Easel 20. Preferably, top side 40 is configured at a 45 degree angle with respect to back side 30 (i.e. the angle referenced by arrow B is preferably 45 degrees). It can be appreciated that the angle represented by arrow B can be varied depending upon the desired use, and preferably is an acute angle. It can further be appreciated that the angle represented by arrow C (i.e. the relationship between top side 40 and back side 30) is an angle something other than that represented by arrow B. However, preferably the angle represented by arrow C and of arrow B are equal. As shown in FIG. 1, leg 34*a* is an angled edge of frame 22.

Figure 6:
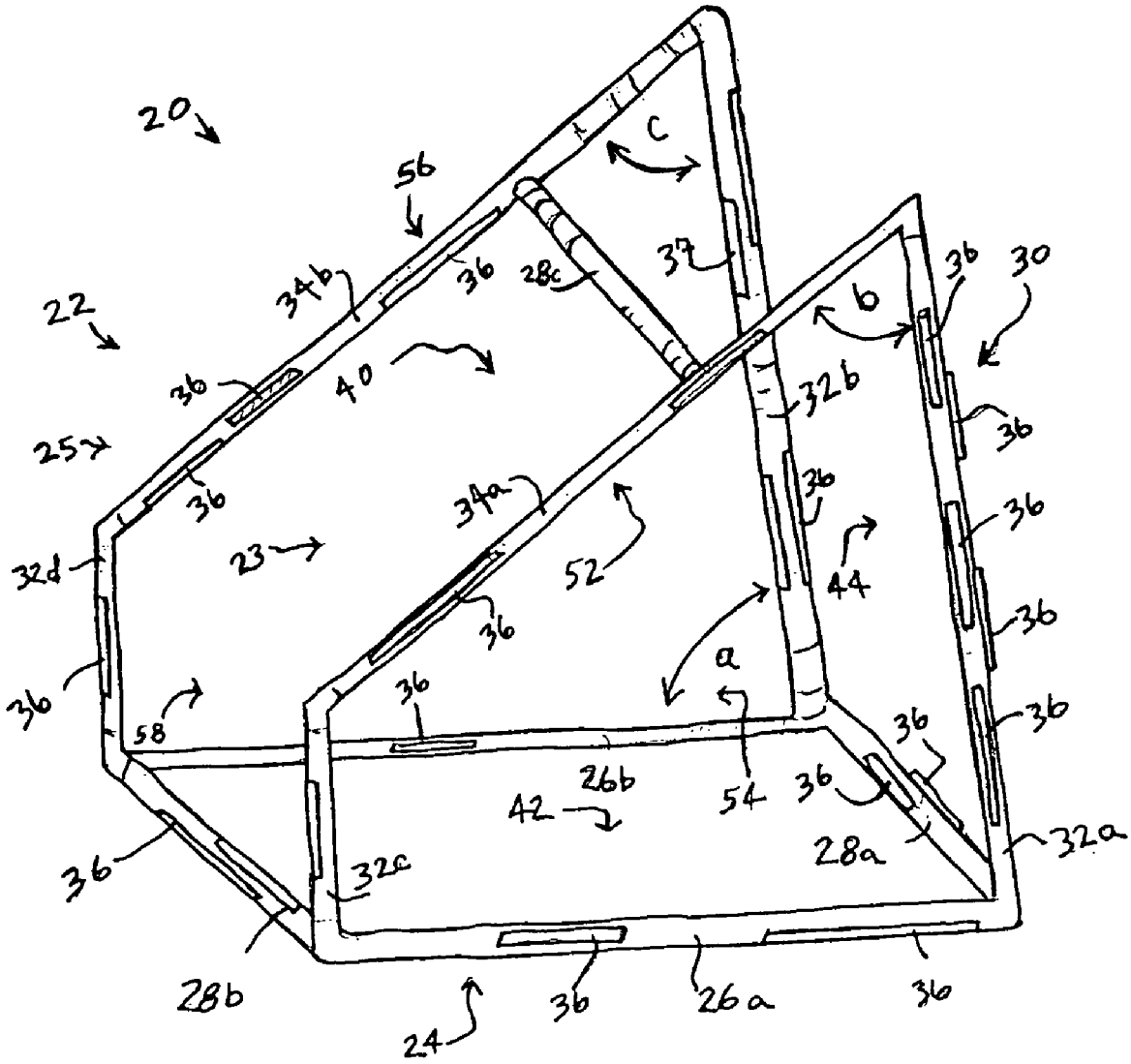
FIG. 6 is a perspective view of a further aspect of the present invention.

While work surface 38 can be detachably fastened to frame 22 at the external edges of legs 25, it can also be appreciated that work surface 38 can be fastened to an inside portion of the inner side of legs 25. For instance, hook-and-loop fastener 37 is connected to leg 32*b* at an interior portion of the bounded interior space 23. Such configuration allows work surface 38 to be fastened (not shown) to back side 30 of easel 20 at the inner space 23. This configuration allows for a stringed sponged type of activity wherein wet painting sponges can be suspended from legs 25 (in this case leg 28*c*). When painted sponge (not shown) is drawn opposite back side 30 and subsequently released, the sponge moves in a pendulum action thereby imparting a paint design on the work surface 38. The angle at arrow A can be lessened to accommodate for a greater pendulum motion. A further aspect of the invention is shown in FIG. 6 where leg 28*c* is positioned inward or toward side 58 to act as a suspension leg for suspending objects including but not limited to objects such as the sponge reference above. Such suspension leg 28*c* allows for a variety of art activities. In operation an artist, student or user can participate in creating artwork with minimal effort. In a further aspect of the invention, legs 25, for instance legs 32*a,b*, can be lengthened or shortened to accommodate various angles. While not shown, legs 25 may include one of a variety of length adjustment mechanisms to accommodate a variety of configurations of easel 20.

A bulldog clip 46 can be utilized with work surface 38 to hold the canvas or artistic printing medium. Further, wheelchair tray clamps (not shown) can be utilized in conjunction with easel 20 for attachment to a wheelchair or a wheelchair tray.

Preferably, hollow PVC tube-like structures are used for legs 25 and preferably include a stretch cord (not shown) running through the tubes. The stretch cords allow for easy assembly and disassembly of leg/tube structures as is commonly understood by one skilled in the art. With stretch cord, easel 20, or at least a portion of easel 20, is collapsible for easy transport, storage, and quick assembly. Preferably, work surface 38 also includes storage bag or pouch 50 (not shown) on a back side for convenient storage of collapsed frame 22.

It can be appreciated that easel 20 can be orientated in a variety of positions such that any one of sides 29 can be used for fastening of work surface 38, while simultaneously providing another one of sides 29 (or legs 25) for use in support of easel 20 to a wheelchair, table, or other surface (with or without a clamp). Alternatively a grip may be placed between the surface and easel 29 to inhibit movement of easel 29 during art operation.

Figure 4:
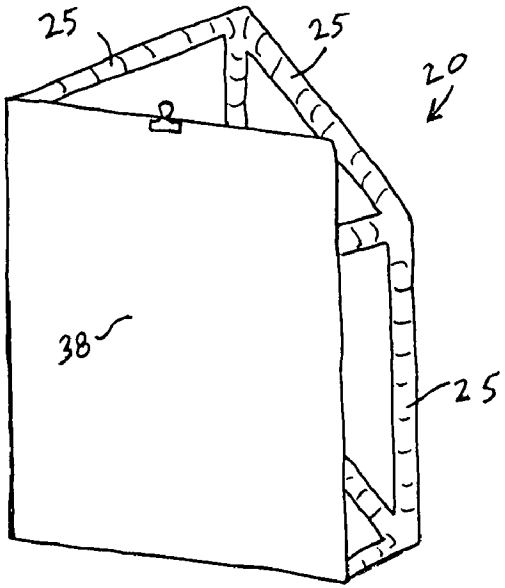
FIG. 4 is a perspective view of the present invention positioned on a side and having an attached work surface.
Figure 5:
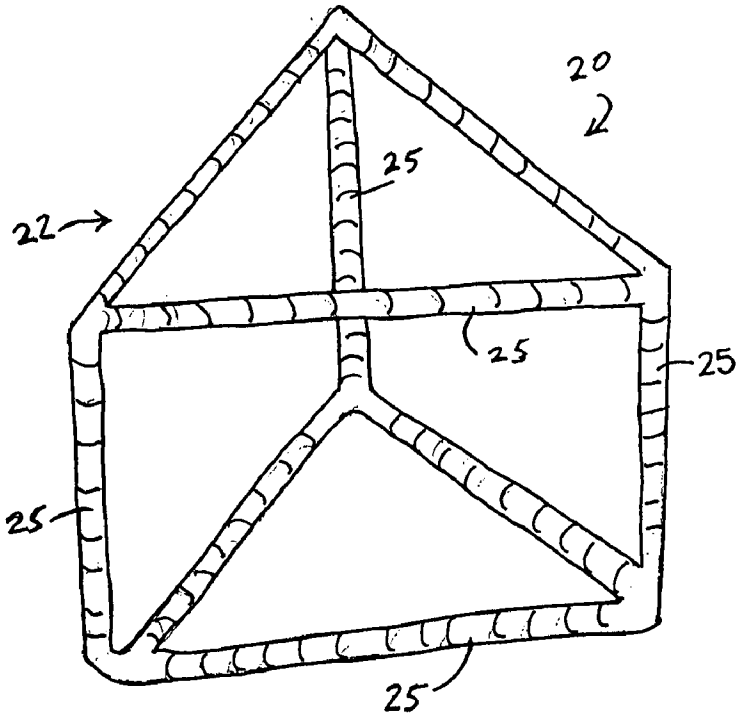
FIG. 5 is a perspective view of a further aspect of the present invention.

As shown in FIG. 4, a further aspect of easel 20 together with work surface 38 is shown. In this case easel 20 is placed on a side with work surface configured portrait-wise for a selected use. It can be appreciated that easel 20 may be placed on different sides with work surface 38 detachably connected to any number of legs 25 as desired. FIG. 5 shows a further aspect of the present invention where easel 20 has five sides defined by legs 25.

The descriptions above and the accompanying drawings should be interpreted in the illustrative and not the limited sense. While the invention has been disclosed in connection with embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. An adaptive easel accommodating multiple orientations, said easel comprising:

a plurality of legs, at least two of said legs connected to define a first side upon which said easel sits, and at least two of said legs connected to define a second side upon which said easel alternatively sits, at least one of said legs capable of receiving a work surface; and a work surface connected to at least one of said plurality of legs;

whereby said easel may sit in a variety of orientations to present said work surface in a variety of orientations.

2. The easel according to claim 1 further comprising a work surface detachably connected to at least a first pair of said legs.

3. The easel according to claim 2 wherein said work surface has a first white board side and a second side having at least two hook-and-loop fastener strips.

4. The easel according to claim 2 wherein said work surface alternatively attaches to a second pair of said legs, said work surface configured to receive an artistic medium.

5. The easel according to claim 4 wherein at least one leg of said first pair is the same as at least one leg of said second pair, and wherein said work surface includes an artistic medium.

6. The easel according to claim 1 wherein at least one of said legs defining said first side is the same as at least one of said legs defining said second side.

7. The easel according to claim 2 wherein at least one of said legs includes at least one attachment mechanism selected from the group consisting of a stick pin, suction cup, magnet, hook, strap, snap on device, or hook-and-loop fastener, detachably connected to said work surface.

8. The easel according to claim 7 wherein an attachment mechanism is connected to each of said plurality of legs.

9. The easel according to claim 1 wherein said legs are hollow tubes.

10. The easel according to claim 1 wherein at least two of said legs are hollow tubes and wherein said hollow tubes include a centrally disposed stretch cord to accommodate elastic separation and connection of said tubes.

11. The easel according to claim 10 wherein said easel is selectively collapsible.

12. The easel according to claim 1 wherein said easel includes at least six legs defining at least four sides.

13. The easel according to claim 1 wherein said first side is positioned at an acute angle with respect to said second side.

14. The easel of claim 1 wherein said plurality of legs defines at least two sides and wherein two and only two of said at least two sides are oriented substantially perpendicular to each other.

15. The easel of claim 1 wherein said plurality of legs bounds an interior space, said work surface detachably connected to an inner side of at least one of said legs.

16. An adaptive easel accommodating multiple work surface orientations, said easel comprising:

a plurality of legs, at least two of said legs connected to define a first side, and at least two of said legs connected to define a second side; and a work surface detachably connected to said legs at said first side and alternatively detachably connected to said legs at said second side;

whereby said work surface may be selectively connected to said easel to accommodate a variety of work surface orientations.

17. The easel according to claim 16 wherein at least one of said legs defining said first side is the same as at least one of said legs defining said second side, and wherein said easel sits upon said first side and alternatively sits upon said second side.

18. A multi-positionable easel comprising:

a frame having multiple sides and defining at least a first side upon which said easel sits and at least a second side upon which said easel alternatively sits; and a work surface detachably connected to at least one of said sides and alternatively detachably connected to at least another of said sides, said work surface configured to receive an artistic medium;

whereby said work surface may be selectively connected to said easel to accommodate a variety of work surface orientations.

19. The easel of claim 18 wherein said easel includes a wheelchair tray clamp and a bull dog clip, and wherein said work surface includes a hook-and-loop fastener.

20. The easel of claim 18 wherein said frame comprises a plurality of hollow tubes and wherein at least two of said tubes include a detachably connecting stretch cord.

21. The easel of claim 18 wherein said easel further includes a third side, at least two of said sides defining an acute frame angle.

22. A multi-positionable easel comprising:

a frame having at least a first side, a second side, and a third side, at least two of said sides positioned substantially perpendicularly to each other; and a work surface selectively and detachably connected to said easel at either said first side or said second side;

whereby said work surface may be selectively connected to said easel to accommodate a variety of work surface orientations.

* * * * *